US009788587B2

(12) United States Patent
Auranen et al.

(10) Patent No.: US 9,788,587 B2
(45) Date of Patent: Oct. 17, 2017

(54) HELMET SYSTEM WITH A WEARABLE CHASSIS

(71) Applicants: Pasi Auranen, Salo (FI); Mika Bordi, Espoo (FI); Tomi Kankainen, Kauniainen (FI)

(72) Inventors: Pasi Auranen, Salo (FI); Mika Bordi, Espoo (FI); Tomi Kankainen, Kauniainen (FI)

(73) Assignee: SAVOX COMMUNICATIONS OY AB (LTD), Espoo (FI)

( * ) Notice: Subject to any disclaimer, the term of this patent is extended or adjusted under 35 U.S.C. 154(b) by 113 days.

(21) Appl. No.: 14/406,627

(22) PCT Filed: Jun. 13, 2013

(86) PCT No.: PCT/FI2013/050652
§ 371 (c)(1),
(2) Date: Dec. 9, 2014

(87) PCT Pub. No.: WO2013/186444
PCT Pub. Date: Dec. 19, 2013

(65) Prior Publication Data

US 2015/0157079 A1 Jun. 11, 2015

(30) Foreign Application Priority Data

Jun. 13, 2012 (WO) ..... PCT/FI2012/050598

(51) Int. Cl.
*A42B 3/04* (2006.01)
*F41H 1/04* (2006.01)

(52) U.S. Cl.
CPC ..... *A42B 3/0406* (2013.01); *A42B 3/04* (2013.01); *F41H 1/04* (2013.01)

(58) Field of Classification Search
CPC ..... A42B 3/04; A42B 3/042; A42B 3/30
See application file for complete search history.

(56) References Cited

U.S. PATENT DOCUMENTS 5,467,479 A * 11/1995 Mattes ..... G02B 23/125 2/422
5,603,117 A * 2/1997 Hudner, Jr. ..... A42B 3/127 2/423

(Continued)

FOREIGN PATENT DOCUMENTS

WO 2004/084664 A2 10/2004
WO 2006/127940 A1 11/2006
WO 2010/074791 A1 7/2010

OTHER PUBLICATIONS

International Search Report, dated Oct. 4, 2013, from corresponding PCT application.

(Continued)

*Primary Examiner* — Richale Quinn
(74) *Attorney, Agent, or Firm* — Young & Thompson

(57) ABSTRACT

A wearable chassis for a helmet has a shape suitable to be worn on a head of a user and being attachable inside a protective structure having a shape protecting the user's from an external impact. The chassis includes one or more connection ports for connecting an electronic device, a control interface for connecting a control unit, a wiring arrangement for connecting the one or more connection ports to the control interface, and a mounting arrangement for attaching an accessory device to the chassis. Moreover, a helmet including such a chassis and the protective structure having a shape protecting a head of a user from an external impact attached to the chassis, as well as a helmet arrangement including such a chassis and one or more protective structures, each having a shape protecting a head of a user from an external impact, removably attachable to the chassis are provided.

18 Claims, 7 Drawing Sheets

(56) References Cited

U.S. PATENT DOCUMENTS 6,560,029 B1 * 5/2003 Dobbie ..... G02B 23/125 2/6.1
6,662,370 B1 * 12/2003 Buchanan, Jr. ..... A42B 3/04 2/422
6,732,381 B1 * 5/2004 Lal ..... A42B 3/0433 2/422
6,804,829 B2 * 10/2004 Crye ..... A42B 3/08 2/10
7,181,192 B2 * 2/2007 Panasik ..... H04M 1/72538 340/436
7,219,370 B1 * 5/2007 Teetzel ..... A42B 3/04 2/422
7,418,738 B2 * 9/2008 Prendergast ..... A42B 3/04 2/22
7,444,683 B2 * 11/2008 Prendergast ..... A42B 3/04 2/422
7,963,426 B2 * 6/2011 Gruebel ..... H01R 13/73 2/422
8,001,623 B2 * 8/2011 Gertsch ..... A42B 3/04 2/410
8,020,220 B2 * 9/2011 McElroy ..... A42B 3/04 2/467
8,209,780 B1 * 7/2012 Lemire ..... A42B 3/04 2/422
8,337,036 B2 * 12/2012 Soto ..... A42B 3/04 362/103
8,375,473 B2 * 2/2013 Celona ..... A42B 3/04 2/422
8,400,510 B2 * 3/2013 O'Rourke ..... G02B 27/0176 348/135
8,531,592 B2 * 9/2013 Teetzel ..... A42B 3/042 345/7
8,701,212 B2 * 4/2014 Daniels ..... A61F 9/067 2/8.2
8,773,537 B2 * 7/2014 O'Rourke ..... H04N 7/185 348/158
8,826,463 B2 * 9/2014 Teetzel ..... A42B 3/04 2/422
8,984,665 B2 * 3/2015 Celona ..... A42B 3/04 2/422
9,116,355 B2 * 8/2015 Teetzel ..... G02B 23/16
9,210,963 B1 * 12/2015 Ellis ..... A42B 3/30
9,243,870 B2 * 1/2016 Teetzel ..... F41G 11/003
2003/0071766 A1 * 4/2003 Hartwell ..... A42B 3/30 345/8
2009/0307826 A1 * 12/2009 Rogers ..... A42B 3/04 2/422
2011/0197327 A1 * 8/2011 McElroy ..... A42B 3/04 2/2.5

OTHER PUBLICATIONS

International Search Report, dated Jan. 14, 2013, from corresponding PCT/FI2012/050598 application.

* cited by examiner

HELMET SYSTEM WITH A WEARABLE CHASSIS

FIELD OF THE INVENTION

The invention relates to a chassis for a helmet. In particular, the invention relates to a chassis that is attachable to a protective structure to provide a helmet and to a helmet or a helmet system comprising such a chassis.

BACKGROUND OF THE INVENTION

Helmets are used as a standard piece of equipment in many military and non-military applications to provide protection for the head of a user. In military applications helmets equipped with a protective shell providing ballistic protection against bullets and/or shrapnel are typically used combat conditions, while helmets equipped with a protective shell providing impact protection may be used in training conditions. In non-military applications, helmets equipped with a protective shell providing impact protection are typically used for example by the police, by firefighters, by the construction workers, by miners, etc.

Lately, helmets that may be equipped with further components or devices have emerged and found use especially in military applications, while also many non-military applications of helmets, such as the ones mentioned above, may make use of further components that may be attached to a helmet. Such additional components or devices may include, for example, imaging devices and/or communication devices.

However, the current solutions for attaching further components or devices to a helmet are typically tailor-made solutions designed for a certain helmet, thereby calling for duplication and re-design of the arrangements required for attaching further components or devices for each helmet type separately, consequently leading to rather costly development and manufacturing of such helmets.

SUMMARY OF THE INVENTION

It is an object of the present invention to provide an arrangement that facilitates a helmet and a helmet system that enables extending the helmet with electronic devices and/or convenient attachment of accessory components or devices to the helmet while at the same time providing cost-effective manufacturing and designing of helmets of different types for different purposes.

According to a first aspect of the invention, a wearable chassis for a helmet is provided, the chassis having a shape suitable to be worn on a head of a user and the chassis being attachable inside a protective structure having a shape protecting the head of the user from an external impact. The chassis comprises one or more connection ports for connecting an electronic device, a control interface for connecting a control unit, and a wiring arrangement for connecting the one or more connection ports to the control interface. The chassis further comprises a mounting arrangement for attaching an accessory device to the chassis.

According to a second aspect of the invention a helmet is provided, the helmet comprising a chassis according to the first aspect of the invention and the protective structure having a shape protecting a head of a user from an external impact attached to the chassis.

According to a third aspect of the invention, a helmet arrangement is provided, the helmet arrangement comprising a chassis according to the first aspect of the invention and one or more protective structures, each having a shape protecting a head of a user from an external impact, removably attachable to the chassis.

The exemplifying embodiments of the invention presented in this patent application are not to be interpreted to pose limitations to the applicability of the appended claims. The verb "to comprise" and its derivatives are used in this patent application as an open limitation that does not exclude the existence of also unrecited features. The features described hereinafter are mutually freely combinable unless explicitly stated otherwise.

The novel features which are considered as characteristic of the invention are set forth in particular in the appended claims. The invention itself, however, both as to its construction and its method of operation, together with additional objects and advantages thereof, will be best understood from the following detailed description of specific embodiments when read in connection with the accompanying drawings.

DETAILED DESCRIPTION

Figure 1:
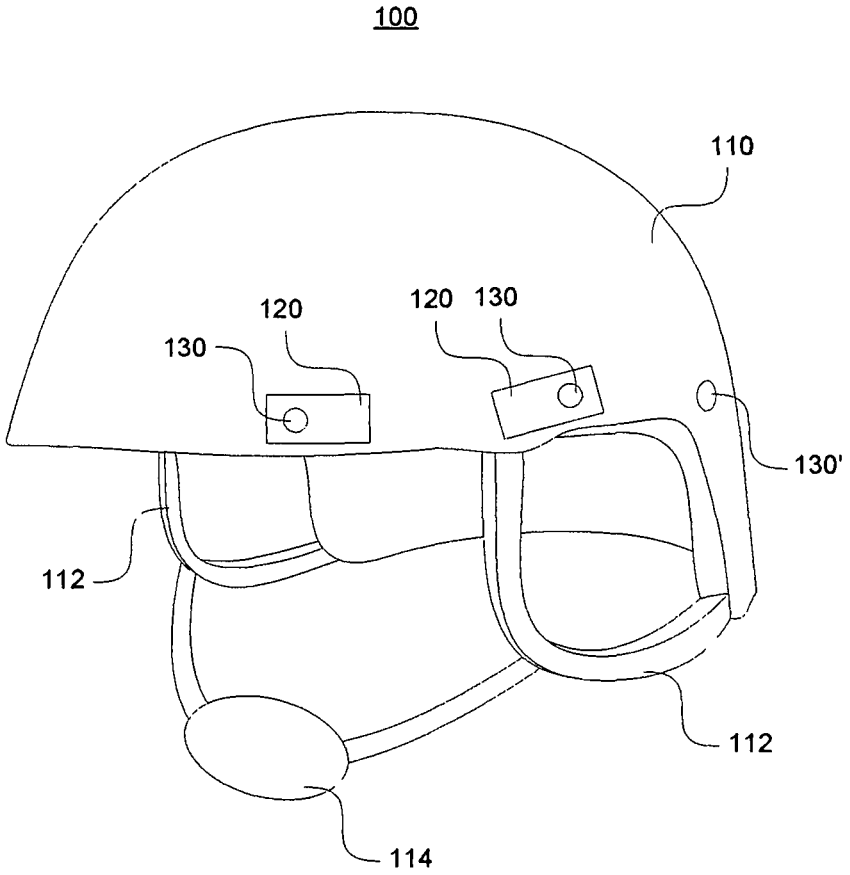
FIG. 1 schematically illustrates a chassis for a helmet in accordance with an embodiment of the invention.

FIG. 1 schematically illustrates a chassis 100 for a helmet. The body 110 of the chassis 100 has a shape that makes it suitable to be worn on a head of a user. In particular, the surface of the body 110 designed to be facing the top of the head of a user preferably has a shape that approximates the shape of the upper part of the human head, thereby making the chassis 100 suitable to be worn on a head of a user. This portion of the body 110 may be referred to as a top portion. The body 110 of the chassis 100 may further comprise a back portion integrated to the top portion for improved fit with a head of a user. The surface of the back portion designed to be facing the back of the head of a user preferably has a shape that approximates the shape of the back of the head of a user.

Without losing generality, this surface of the body 110 designed to be facing the head of the user when worn by the user is referred to in the following as an inner surface or an inner side of the chassis 100 or as an inner surface or an inner side of the body 110 for brevity of description. In contrast, the opposite side or surface of the body 110 is referred to in the following as an outer surface or an outer side of the chassis 100 or as an outer surface or an outer side of the body 110.

The chassis 100 is attachable to a protective structure having a shape protecting the head of a user from an external impact. In particular, the chassis 100 is attachable inside the protective cover such that the protective cover fully or partially covers the body 110 of the chassis 100. Hence, the chassis 100, when attached inside the protective structure, forms a wearable portion of the helmet comprising the chassis 100 and the protective structure. When a user is wearing such a helmet, the inner side of the body 110 of the chassis 100 (or a fitting arrangement possibly provided in the inner side of the body 110, as will be described later in more detail) is hence directly facing the head of the user. Therefore, the chassis 100 may be referred to as a wearable chassis. Details of the protective structure and means for attaching the protective structure to the body 110 of the chassis 100 are discussed hereinafter.

A benefit of such an arrangement is that the chassis 100 and any components comprised therein are also protected by the protective structure, thereby reducing the risk of external impacts, weather conditions, dust or dirt, etc. damaging the chassis 100 or any components comprised therein.

The chassis 100 may be optionally provided with one or more openings through the body 110 in order to provide improved ventilation and/or to reduce weight of the chassis 100. This may provide improved user comfort in warm or hot usage conditions and/or in case of intensive movement of the person wearing the chassis 100. Alternatively, the body 110 may be provided without openings to reduce heat dissipation through the body 110 for improved user comfort in cold usage conditions.

The body 110 may have a layered structure, comprising one or more layers of rigid or essentially rigid material and one or more layers of soft flexible material. As a particular example, the body 110 may comprise a first layer of rigid or essentially rigid material as the outermost layer, a second layer of rigid or essentially rigid material as the innermost layer, and a layer of soft flexible material between the first and second layers of rigid or essentially rigid material. The one or more layers of rigid or essentially rigid material may hence serve to provide durable surfaces to the body 110 at the same defining the overall shape of the body 110, whereas the one or more layers of soft flexible material may serve to provide impact protection. As an example, the one or more layers of rigid or essentially rigid material may comprise injection moulded plastic material, such as polyoxymethylene (POM) and/or high-density polyethylene (HDPE), and the one or more soft flexible material may comprise e.g. polyethylene and/or polystyrene. The term essentially rigid material as used herein refers to a material that may exhibit some flexibility in order to allow minor temporary deformation that may be required e.g. when installing components to the body 110 or when fitting the chassis 100 to a head of user, but that retains its overall shape.

Consequently, with the structure of the body 110 of the chassis 100 designed to provide impact protection, the wearable chassis 100 may be applied for protecting the head of a user also without the protective structure attached thereto e.g. in usage or operating conditions where extreme protections is not required. In other words, the wearable chassis 100 as such may be employed as a helmet for example in conditions where improved user comfort e.g. due to lighter structure of the helmet and improved ventilation through the helmet outweighs the additional protection provided by the additional protective structure that can be attached to cover the wearable chassis 100.

The inner side of the top portion of the body 110 may have a shape that directly fits the upper part of the human head. Similarly, the possible back portion of the body 110 may have a shape that directly fits the back of the head. Alternatively or additionally, due to the heads coming in different shapes and sizes, the inner side(s) of the portion(s) of the body 110 may be provided with a fitting arrangement for improved fit to a head of a particular user. The fitting arrangement may comprise a set of one or more pads comprising soft flexible material, such as polyethylene and/or polystyrene, attachable on the inner surface of the chassis 100. The one or more pads serving as the fitting arrangement may be made of soft flexible material, the one or more pads may have a layer made of soft flexible material or the one or more pads may otherwise comprise soft flexible material to extent making the one or more pads soft and flexible enough in order to serve as an arrangement to improve fitting in the head of the particular user.

The one or more pads may be attached, e.g. glued, to the body 110 in a fixed manner, thereby requiring attachment of suitable pads when preparing a chassis 100 for a specific user, possibly also for a specific use. Alternatively, the pads may be detachably attachable to the body 110. In particular, a chassis 100 may be provided with one or more sets of one or more pads comprising soft flexible material such that a set of one or more pads comprises pads of certain thickness, thereby facilitating fitting the chassis 100 with heads of different sizes. Consequently, the user may choose and attach a set of pads providing the most suitable fit in view of the usage scenario and/or the current user of the chassis 100. The (detachable) attachment of the pads may be provided for example by using Velcro as the attachment means. In particular a surface of a pad to be attached to the inner surface of the body 110 may comprise Velcro hooks and the respective attachment point in the inner surface of the body 110 may comprise Velcro loops—or vice versa. Instead of Velcro, a corresponding hook-and-loop attachment means may be employed.

As another example, the one or more pads may be (detachably) attachable to the inner surface of the body 100 by press fit, e.g. by providing a projection or a ridge in a surface of a pad to be attached to the inner surface of the body 110, while the respective attachment point in the inner surface of the body 110 may be provided with an opening or a bore configured to accept the projection or the ridge in a manner providing a press fit between the projection/ridge and the opening/bore.

The body 110 of the chassis 100 may be adjustable in order to provide (further) improved fit with the head of a user. In this regard, the chassis 100 may be provided with a size adjustment arrangement that may be used to change the circumference of the body 110 to fit the head of a user. The adjustment arrangement may be controllable for example by a rotatable adjustment wheel coupled thereto, turning of which is arranged to cause sub-portions of the body 110 to be moved with respect to each other such that the circumference of the body 110 is changed in accordance with the extent of turning the rotatable adjustment wheel. Additionally or alternatively, the size adjustment may be arranged to cause the portions of the body 110, e.g. the top portion and the back portion, to be moved with respect to each other.

The chassis 100 may further comprise an arrangement for detachably securing the chassis 100 to the head of a user. The securing arrangement may comprise two side portions 112 extending from the body 110, as indicated in FIG. 1.

Each side portion 112 may be attached to a side of the body 110 such that when the chassis 100 is worn by a user, a side portion 110 forms a loop encircling an ear of the user, thereby providing improved fit with the head of the user while at the same time leaving the ear exposed to enable the user to wear an earphone arrangement or an hearing protection arrangement together with the chassis 100. The securing arrangement may further comprise a chin portion or a chin strap 114 attached to the two side portions 112, the chin portion or the chin strap being securable to a chin of the user for further improved fit with the head of the user. Alternatively, the securing arrangement may be provided without the side portions 112 with a chin portion or a chin strap 114 being directly attached to the body 110 instead of being attached to the body 110 via the side portions 112. The securing arrangement may be detachably attached to the body 110 of the chassis 100 and/or the chin portion or the chin strap 114 may be detachably attached to the body 110 or to the side portions 112.

The chassis 100 may further comprise a mounting arrangement for attaching one or more accessory devices to the chassis 100. The mounting arrangement for attaching one or more accessory devices may comprise one or more accessory rails 120, arranged e.g. in a portion of the rim of the body 110 of the chassis 100, as schematically illustrated in FIG. 1. The accessory rails may also be referred to as mounting rails. In particular, the mounting arrangement may comprise one or more accessory rails 120 arranged to encircle or partially encircle the body 110 near the rim of the outer surface of the body 110. Additionally or alternatively, the mounting arrangement may comprise accessory rails or mounting points of another type in other parts of the chassis 100. Mount points of another type may enable attaching an accessory device e.g. by press fit, by a latch arrangement, by a screw arrangement, etc. In particular, the mounting arrangement may comprise one or more STANAG 2324 rails (a.k.a. Picatinny rails), one or more STANAG 4694 rails (a.k.a. NATO accessory rails) and/or corresponding arrangements for detachably mounting accessory devices equipped with mounting means according to the respective standard.

One or more of the one more mounting rails, e.g. STANAG 2324 rails, STANAG 4649 rails and/or the mounting points of other type may be provided with a connection port for connecting an electronic device to the chassis 100, as described in more detail hereinafter.

The mounting arrangement hence may enable detachably mounting one or more accessory devices, such as one or more of a lamp, a night vision device, an imaging device, a speaker arrangement, a microphone arrangement, a compass arrangement, an accelerometer arrangement, a sensor arrangement of other type, etc. equipped with means for attaching the accessory device to the type of the mounting arrangement provided in the body 110 of the chassis 100. The accessory device typically also constitutes an electronic device to be connected to the chassis 100 via a connection port, as described in more detail hereinafter.

An accessory rail or mounting point of another type comprised in the mounting arrangement may be provided as a generic mounting point that enables attaching any accessory device equipped with means suitable for attachment thereto or as a dedicated mounting point that enables attaching an accessory device of a predetermined type, e.g. a device configured to perform a predetermined function. Such dedicated mounting points are preferably arranged at or near the rim of the outer surface of the body 110 or in the back portion of the body 110. As non-limiting examples, an accessory device of a predetermined type may be a microphone arrangement or a speaker arrangement such as a headphone.

Figure 2:
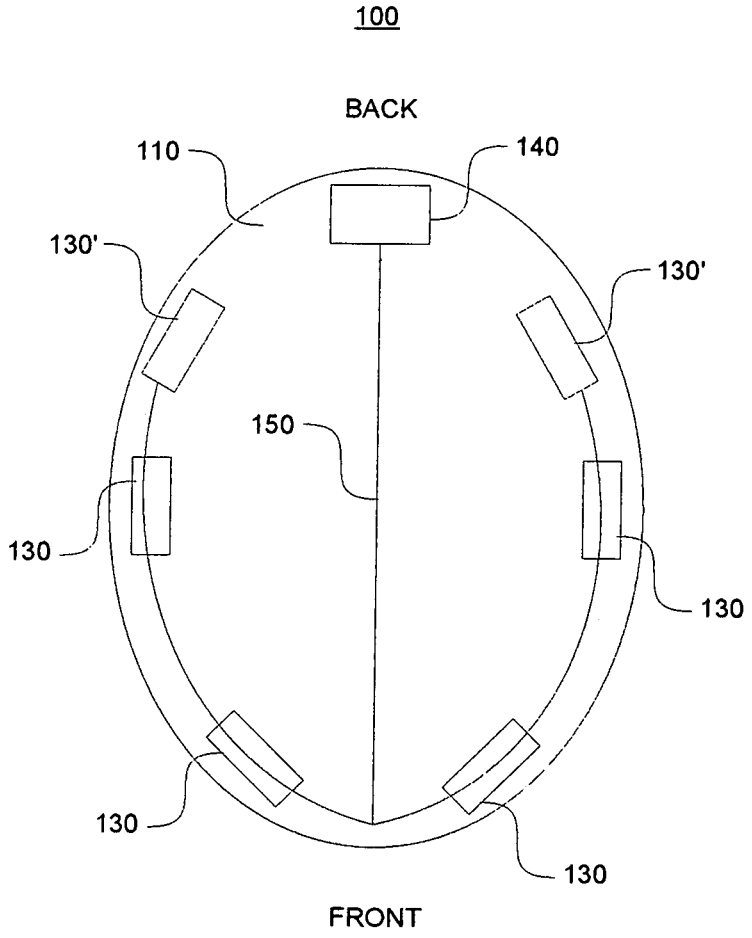
FIG. 2 schematically illustrates a chassis for a helmet in accordance with an embodiment of the invention.

The chassis 100 further comprises one or more connection ports 130, 130' for connecting an electronic device to the chassis 100, as schematically illustrated in FIGS. 1 and 2. Moreover, the chassis 100 comprises a control interface 140 for connecting a control unit, and a wiring arrangement 150 for connecting the one or more connection ports 130, 130' to the control interface 140, as indicated in FIG. 2 schematically illustrating the body 110 of the chassis 100 from the above, i.e. providing a view towards the outer surface of the body 110 of the chassis 100. While e.g. FIG. 2 suggests six connection ports 130, 130', the chassis 100 may comprise any number of connection ports considered suitable for the intended use of the chassis. Moreover, although FIG. 2 illustrates the connection ports 130, 130' and the control interface 140 arranged close to the rim of the body 110, this serves as a non-limiting example and the connection ports 130, 130' and the control interface 140 may be provided in any suitable location in the body 110. Furthermore one or more of the connection ports 130, 130' and/or the control interface 140 may be, alternatively, provided in other parts of the chassis 100, e.g. in the side portion 112.

A connection port 130, 130' may be a dedicated connection port for connecting an electronic device of a predetermined type. Alternatively, a connection port 130, 130' may be a generic connection port for connecting any electronic device compliant with the communication protocol, e.g. a data transfer protocol and/or a control protocol provided via the generic communication port. The chassis 100 may comprise one or more dedicated communication ports and/or one or more generic communication ports.

One or more of the one or more connection ports may be provided in conjunction with the mounting arrangement. FIG. 1 schematically illustrates an example of providing the connection ports 130 in conjunction with the mounting rails 120. As a particular example, a connection port 130 may be integrated to a mounting rail 120 such as a STANAG 2324 rail or to a STANAG 4649 rail, thereby providing a modified STANAG 2324 rail or a modified STANAG 4649 rail, respectively. Such a connection port 130 integrated to amounting rail 120 may be a dedicated connection port or a generic connection port. Attaching an accessory device to such a mounting rail 120 provided jointly with a connection port 130 enables at the same time electrically connecting the accessory device to the control interface.

One or more of the one or more connection ports 130, 130' may be dedicated connection ports for connecting a speaker arrangement. A dedicated connection port for connecting a speaker arrangement may be configured to provide an audio signal from the control interface to the connection port, and consequently to one or more speakers of the speaker arrangement. Such a connection port may be provided in conjunction with the mounting arrangement, e.g. as a connection port integrated to a mounting rail, as schematically illustrated by the exemplifying connection ports 130 in FIG. 1. Alternatively or additionally, such a connection port may be provided as a dedicated connection port separate from the mounting arrangement, as schematically illustrated by the exemplifying connection port 130' in FIG. 1. In the former approach the mounting arrangement provides both the attachment of the speaker arrangement to the chassis 100 and the electrical connection to the control interface, whereas in the latter approach the speaker arrangement may be attachable to the mounting arrangement or may be made otherwise available to the person wearing the chassis 100 while the electrical connection is provided by the dedicated connection port 130' separate from the mounting arrangement. Examples of a speaker arrangement include a headphone or headphones comprising one or more speakers, an in-ear headphone (e.g. an earphone), an earmuff or a pair of earmuffs comprising one or more speakers, etc.

One or more of the one or more connection ports may be dedicated connection ports for connecting a microphone arrangement. A dedicated connection port for connecting a microphone arrangement may be configured to provide an audio signal received via the connection port to the control interface. Like in the case of a dedicated connection port for connecting a speaker arrangement, a dedicated connection port for connecting a microphone arrangement may be provided in conjunction with the mounting arrangement, e.g. as a connection port integrated to a mounting rail like the connection ports 130, or as a dedicated connection port separate from the mounting arrangement like the connection ports 130'. Examples of a microphone arrangement include a boom microphone, a hear-through microphone arranged in a headphone or in an earmuff, an acoustic noise cancellation feedback microphone arranged in a headphone or in an earmuff, one or more microphones of a(n acoustic) sniper detection arrangement or a(n acoustic) gunfire locator arrangement, etc.

One or more of the one or more connection ports may be dedicated connection ports for connecting a combined speaker and microphone arrangement. A dedicated connection port for connecting a combined speaker and microphone arrangement may be configured to provide an audio signal from the control interface to the connection port and to provide an audio signal received via the connection port to the control interface. Like in the case of a dedicated connection port for connecting a speaker arrangement or a dedicated connection port for connecting a microphone arrangement, a dedicated connection port for connecting a combined speaker and microphone arrangement may be provided in conjunction with the mounting arrangement, e.g. as a connection port integrated to a mounting rail, like the connection ports 130, or as a dedicated connection port separate from the mounting arrangement, like the connection ports 130'. Examples of a combined speaker and microphone arrangement include a hear-through microphone arranged in a headphone or in an earmuff, an acoustic noise cancellation feedback microphone arranged in a headphone or in an earmuff, etc.

As described hereinbefore, the chassis 100 comprises a wiring arrangement 150 for connecting the one or more connection ports 130, 130' to the control interface 140, as schematically illustrated in FIG. 2. The wiring arrangement 150 may comprise wiring that enables providing data from the control interface 140 to one or more of the one or more connection ports 130, 130' and wiring that enables providing data via one or more of the one or more connection ports 130, 130' to the control interface 140. Such wiring may be referred to as a data bus. Alternatively or additionally, the wiring arrangement 150 may comprise wiring that enables providing commands or control signals from the control interface 140 to one or more of the one or more connection ports 130, 130' and wiring that enables providing commands or control signals via one or more of the one or more connection ports 130, 130' to the control interface 140. Such wiring may be referred to as a control bus. In other words, for a given connection port of the one or more connection ports 130, 130', the wiring arrangement 150 may be configured to enable transfer of data either in one direction or in both directions between the given connection port 130, 130' and the control interface 140 and/or the wiring arrangement 150 may be configured to enable transfer of commands or control signal either in direction or in both directions between the given connection port 130, 130' and the control interface 140, depending on the intended role of the given connection port 130, 130'. The transfer of data and control information may be provided in the same wiring, or dedicated wirings may be employed for transfer of data and transfer of control information.

The wirings and/or wires comprised in the wiring arrangement 150 may be enclosed within the body 110 of the chassis 100 for maximum protection against external impacts and other external conditions that may cause damage to the wirings and/or wires. Alternatively, the wirings and/or wires or a part thereof may be provided e.g. on the outer surface of the body 110 or on the inner surface of the body 110 for ease of maintenance and replacement of the wirings and/or wires comprised in the wiring arrangement 150. As a particular example, the outer surface or the inner surface of the body 110 may be provided with grooves suitable for installing the wirings and/or wires of the wiring arrangement 150.

The wiring arrangement 150 may comprise a control bus connecting one or more of the one or more connection ports 130, 130' to the control interface 140. The control bus may be provided as a dedicated wiring, hence separate from a data bus, or the control bus may be a logical entity sharing the wiring with the data bus. The control bus may comprise wiring that enables supplying power from or via the control interface 140 to an accessory device connected thereto. The control bus may comprise one or more dedicated control buses, each providing a dedicated wiring between a connection port 130, 130' and the control interface 140, and/or the control bus may comprise a shared control bus providing shared wiring connecting one or more of the one or more connection ports 130, 130' to the control interface 140. The control bus may be configured to employ any protocol suitable for transfer of control information. The transfer of control information may be unidirectional—typically from the control interface 140 to the one or more of the one or more connection ports 130, 130'—or bidirectional. The protocol employed in the control bus may also enable transfer of small amounts of data, either in a unidirectional or bidirectional manner.

As an example of a shared control bus, the control bus may comprise an InterIntegrated Circuit (I2C) bus for connecting one or more of the one or more connection ports 130, 130' to the control interface 140, thereby providing a control bus compliant with an I2C protocol, e.g. in accordance with the I2C version 4 standard. Consequently, I2C compliant communication protocol is employed in communication over the control bus. In case the chassis 100 comprises an I2C bus as the control bus, the control interface 140—or a control unit connected to the control interface 140—acts as the master device, whereas one or more accessory devices connected to one or more of the one or more connection ports 130, 130' act as slave devices.

The wiring arrangement 150 may comprise a data bus connecting one or more of the one or more connection ports 130, 130' to the control interface 140. The data bus may be provided as a dedicated wiring, hence separate from the controt bus, or the data bus may be a logical entity sharing the wiring with the control bus. The data bus may comprise wiring that enables supplying power from or via the control interface 140 to an accessory device connected thereto. The data bus may comprise one or more dedicated data buses, each providing a dedicated wiring between a connection port 130,130' and the control interface 140, and/or the data bus may comprise a dedicated data bus providing shared wiring connecting one or more of the one or more connection ports 130, 130' to the control interface 140. The data bus may be configured to employ any protocol suitable for transfer of data. The transfer of data may be unidirectional —typically from one or more of the one or more connection ports 130, 130' to the control interface 140—or bidirectional. The protocol employed in the data bus may also enable transfer of small amounts of control information, either in a unidirectional or bidirectional manner.

As an example of one or more dedicated data buses, the data bus may comprise dedicated wiring between a connection port 130, 130' and the control interface 140 in compliance with the Universal Serial Bus (USB) standard for one or more of the one or more connection ports 130, 130'. Consequently, USB compliant communication protocol is employed in communication over the data bus, e.g. according to the USB 2.0 standard.

The wiring arrangement 150 may further comprise dedicated wiring for transferring audio data, e.g. an audio signal in analog form, between one or more of the one or more connection ports 130, 130' and the control interface 140. In particular, such dedicated wiring may comprise wiring for transferring audio data from the control interface 140 to one or more dedicated connection ports for connecting a speaker arrangement and/or wiring for transferring audio data to the control interface 140 from one or more dedicated connection ports for connecting a microphone arrangement. Moreover, such dedicated wiring may further comprise wiring that enables providing operating power from or via the control interface 140 to one or more of the one or more dedicated connection ports for connecting a speaker arrangement and/or a microphone arrangement. Such dedicated wiring may also comprise wiring that enables transferring control information between the one or more dedicated connection ports and the control interface 140.

The wiring arrangement 150 may further comprise dedicated wiring for providing operating power from or via the control interface 140 to one or more of the one or more connection ports 130, 130'.

Figure 3:
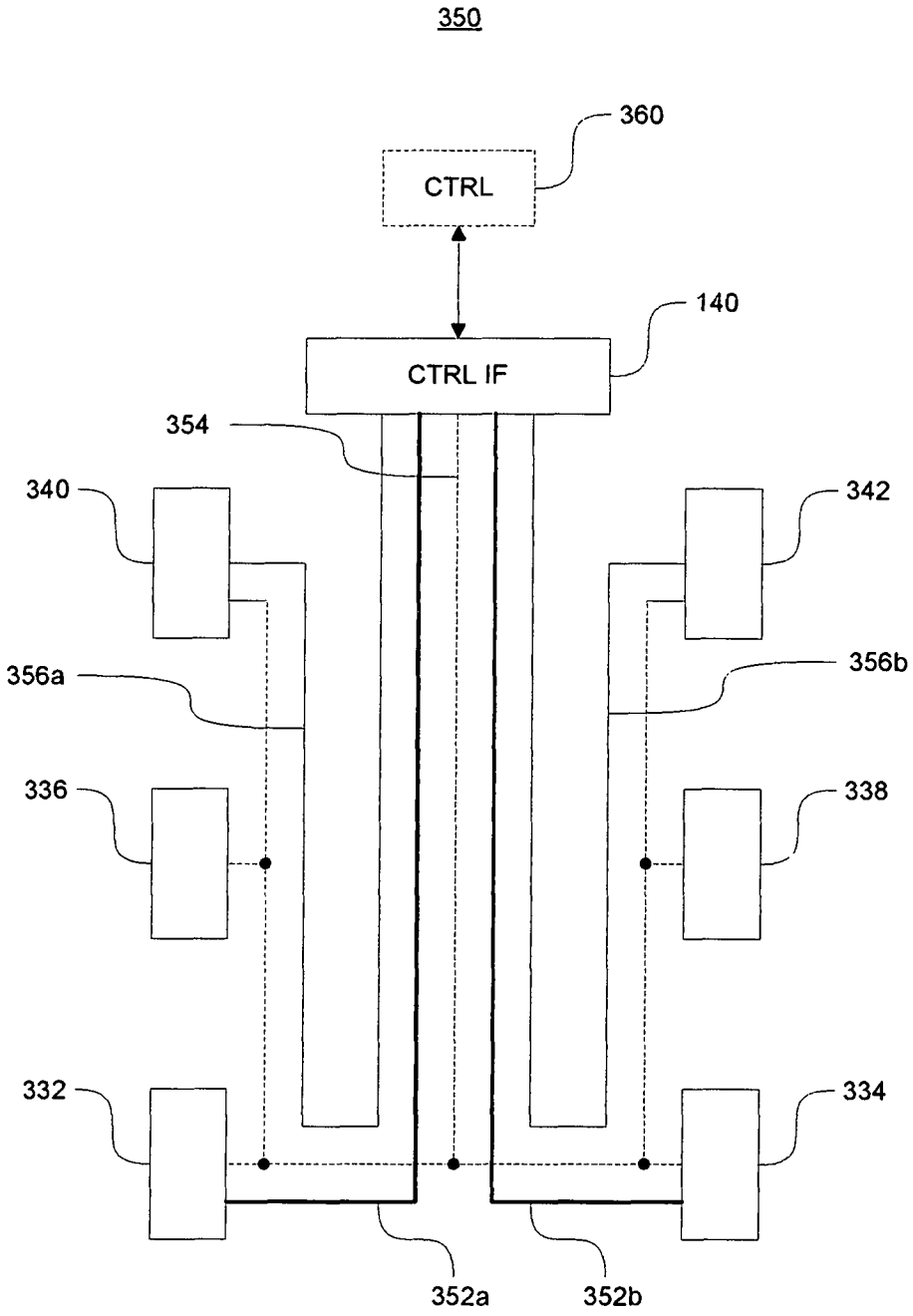
FIG. 3 schematically illustrates an exemplifying wiring arrangement in accordance with an embodiment of the invention.

FIG. 3 schematically illustrates some details of an exemplifying wiring arrangement 350. The exemplifying wiring arrangement 350 may act as the wiring arrangement 150 or the wiring arrangement 150 may comprise the exemplifying wiring arrangement 350. FIG. 3 illustrates the control interface 140, generic connection ports 332, 334, 336 and 338, as well as dedicated connection ports 340 and 342. The exemplifying wiring arrangement comprises a data bus comprising dedicated data buses 352*a* and 352*b*, illustrated as bold lines, connecting the control interface 140 to the generic connection ports 332 and 334, respectively. The exemplifying wiring arrangement further comprises a single shared control bus 354, illustrated as a dashed line, connecting the generic connection ports 332, 334, 336 and 338 as well as the dedicated connection ports 340 and 342 to the control interface 140. The control bus 354 also enables transfer of small amounts of data in addition to the control information primarily transferred therein. The exemplifying wiring arrangement 350 further comprises dedicated wiring for transferring audio data comprising dedicated wirings 356*a* and 356*b*, illustrated as narrow solid lines, connecting the control interface 140 to the dedicated connection ports 340 and 342, respectively.

Both the data bus 352*a*, 352*b* and the control bus 354 may be employed to also provide operating power to the connection ports they are coupled to. The data bus 352 may employ for example a USB protocol, whereas the control bus 354 may employ for example an I2C protocol, both being protocols that may also be employed to provide operating power to the connection ports 332 to 342 connected thereto.

FIG. 3 further illustrates a control unit 360 coupled to the control interface 140. The control unit 360 may be provided as part of the chassis 100 or it may be provided as an entity separate from the chassis 100 that may be coupled or connected to the chassis 100 via the control interface 140. The control unit 360 is described in more detail hereinafter.

A connection port 130, 130' provides an electric contact between the wiring arrangement 150 and an electronic device connected to the connection port 130, 130', thereby electrically coupling the electronic device to the control interface 140 via the wiring arrangement 150. A connection port 130, 130' may provide an electric connection to the control bus, to the data bus, to the dedicated wiring for transferring audio data, to the wiring for providing operating power or to any combination thereof.

As an example, a connection port 130, 130' may comprise a socket for accepting a plug arranged in an electronic device such that a plug inserted in the socket provides an electric contact between the electronic device and the wiring arrangement 150. Such an arrangement may be employed to provide a dedicated connection port or a generic connection port. As a particular example, a socket with two openings, the first one providing one or more contact areas that are able to provide connection to dedicated wiring for transferring audio data and the second one providing one or more contact areas that are able to provide connection to a control bus may be employed, thereby enabling electric contact to an electronic device via a plug provided with two pins employing respective contact areas. Moreover, either or both of the two openings may comprise a contact area that is able to provide operating voltage to a corresponding contact area of the plug inserted thereto.

As a variation of the previous example, the first opening of the socket may provide one or more contact areas that are able to provide connection to a data bus. As a further variation, one or more contact areas that are able to provide connection to dedicated wiring for transferring audio data, to a control bus and/or to a data bus may be provided using a socket with a single opening or a socket with more than two openings.

As another example, a connection port 130, 130' may comprise one or more pins on the surface of the connection port 130, 130'. Such an arrangement may be employed, in particular, to provide a generic connection port in conjunction with a mounting rail 120. Attaching an accessory device equipped with mounting means provided with one or more pins in a corresponding arrangement on its surface to the mounting rail 120 thus enables an electric contact between the electronic accessory device and the wiring arrangement 150. The one or more pins on the surface of the connection port 130, 130' may comprise one or more pins that provide connection to a control bus, one or more pins that provide connection to a data bus and/or one or more pins that provide connection to dedicated wiring for transferring audio data. Moreover, the one or more pins on the surface of the connection port 130, 130' may further comprise one or more pins providing an operating voltage.

As described hereinbefore, the chassis 100 comprises a control interface 140 for connecting a control unit. The control interface 140 may comprise one or more further connection ports for connecting the wiring arrangement 150, e.g. the control bus, the data bus, dedicated wiring for transferring audio data and/or dedicated wiring for providing operating power, to an external control unit and/or to an external control device.

Alternatively, as referred to hereinbefore, the chassis 110 may comprise a control unit 360 for controlling operation of one or more electronic devices connected to the chassis 100, the control unit being connected to the control interface 140. The control unit may further comprise a second interface, e.g. the one or more further connection ports, for connecting an external control device to the chassis 100. The external control device may be for example a communication device configured to provide a communication interface enabling communication to other corresponding communication devices. The external control device may be configured to receive and/or send data and/or commands of control signals over via the second interface, and it may further comprise one or more processors and one more memories to provide (further) capability to process and/or store data received or to be sent over the second interface.

The control unit 360 may comprise one or more power management units for controlling the provision of the operating power via the wiring arrangement 150, e.g. via the control bus, via the data bus, via the dedicated wiring for transferring audio data and/or via the dedicated wiring for proving operating power. The one or more power management units may receive power to be provided via the wiring arrangement 150 from the external control device via the one or more further connection ports. Alternatively or additionally, the controt unit may comprise a power source, such as an arrangement for installing one or more batteries, e.g. a pair of AA batteries or one or more batteries of another type, for supplying power to the control unit.

The control unit 360 may further comprise a control function for controlling the accessory devices connected to the one or more connection ports 130, 130' of the chassis 100 and a processing function for processing the data received from a connection port 130, 130' or to be provided to a connection port 130, 130'. The control functionality and/or the processing function may be provided one or more processing units, such as one or more digital signal processors (DSP) and/or one more general purpose processors. The one or more DSPs may be dedicated to specific function, e.g. to provide control and/or processing function for an electronic device of a predetermined type.

Moreover, the control unit 360 may comprise one or more memory units for storing data received from a connection port 130, 130' or data to be provided to a connection port 130, 130'. The one or more memory units may further serve to store control parameters, settings and computer program instructions that cause the control unit 360, when executed by the one or more processing units, to control the information transfer via the wiring arrangement 150 and/or to process data received from a connection port 130, 130' or data to be provided to a connection port 130, 130'. In particular, control parameters, settings and computer program instructions may comprise driver software for controlling operation of and data exchange with an electronic device of a predetermined type connectable to the chassis 100 and electrically connectable to the processing unit 360 via a control port 130, 130' and the wiring arrangement 150.

The control unit 360 may comprise a data switching function for connecting one of the one or more connection ports 130, 130' coupled to the control interface 140, and hence to the control unit 360 via respective shared data bus to the external control device via the second interface. The data switching function may be provided e.g. by a data hub, for example an USB hub for connecting one of the connection ports 130, 130' connected to the control interface 140 via an USB bus.

Figure 4:
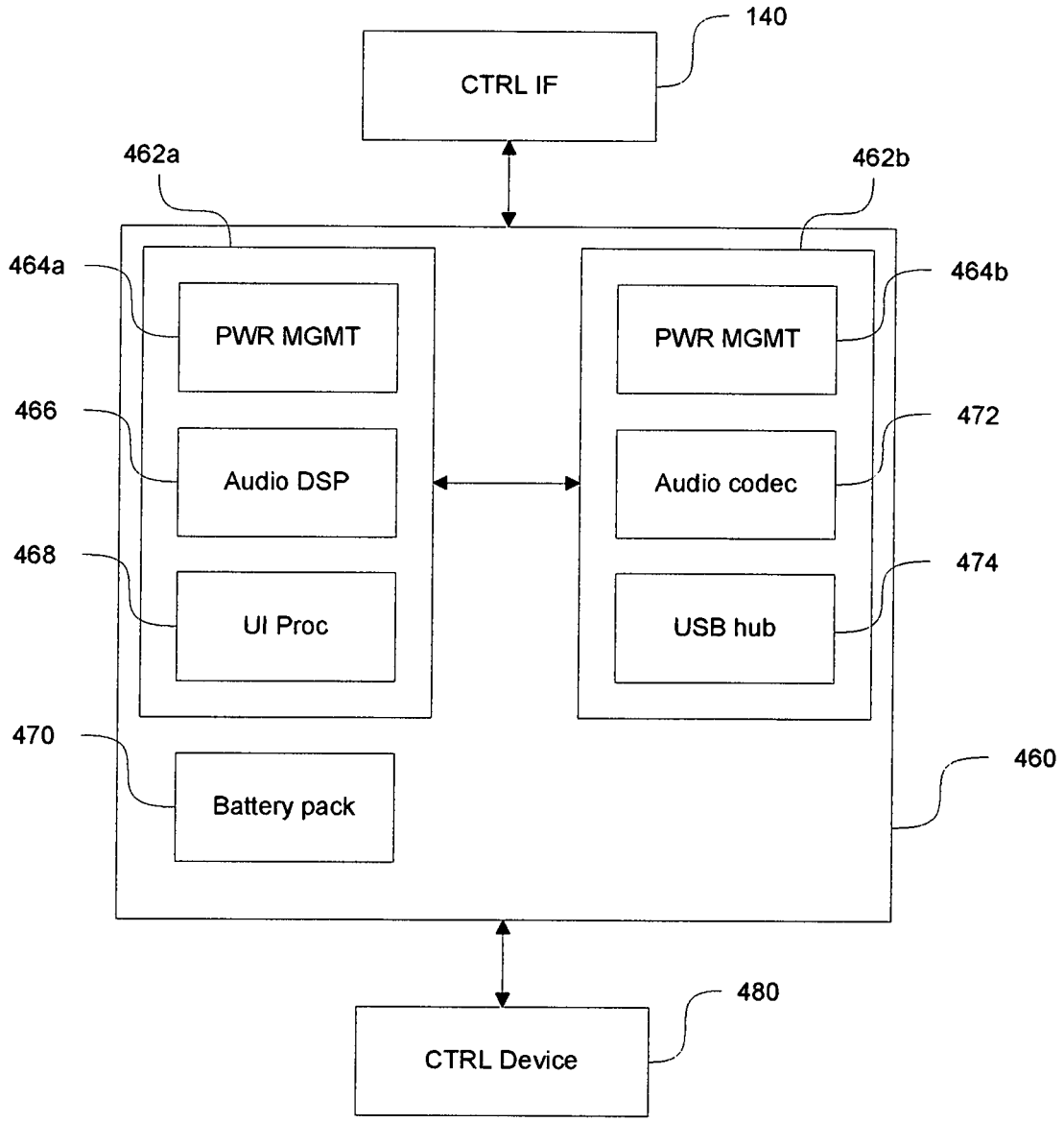
FIG. 4 schematically illustrates a control unit in accordance with an embodiment of the invention.

As an example, FIG. 4 schematically illustrates an exemplifying control unit 460, connected to the control interface 140 and to the external control device 480. The control unit 460 may act as the control unit 360 or the control unit 360 may comprise the control unit 460. The exemplifying control unit 460 comprises a first controller 462*a* and a second controller 462*b*. The first controller 462 comprises a first power management entity 464*a*, an audio DSP 466 and a user interface (UI) processor 468. The first controller 462*a* is further coupled to a battery pack 470. The second controller 462*b* comprises a second power management entity 462*b*, an audio codec 472 and a USB hub 474. The second controller 462*b* is further connected to an external power source e.g. via the second control interface, the external power source provided e.g. at the external control device 480. The control unit 460 may further comprise e.g. memory accessible by one or more of the processing units of the first controller 462*a* and/or one or more of the processing units of the second controller 462*b*.

In case the control unit 460 is not connected to an external control device 480 providing operating power to the control unit 460, only the first controller 462*a* is operational and the first power management entity 464*a* is configured to supply power via the wiring arrangement 150 on basis of the power provided by one or more batteries that may be installed in the battery back 470. On the other hand, in case the external operating power is supplied, the first power management entity 464*a* is configured to supply power on basis of the external operating power.

The audio DSP 466 may be configured to provide active noise cancellation processing applied to an audio signal received from an active noise cancellation microphone connectable to a connection port 130, 130' for provision to a speaker arrangement connectable to the same or another connection port 130, 130'. Alternatively or additionally, as another example, the audio DSP 466 may be configured to provide audio signal enhancement processing applied to an audio signal received from a hear-through microphone connectable to a connection port 130, 130' for provision to a speaker arrangement connectable to the same or another connection port 130, 130'.

The UI processor 468 is configured to control the operation of the first controller 462*a*. The UI processor 468 may be provided e.g. as microcontroller or a general purpose processor. The UI processor 468 may comprise a memory or the UI processor 468 may be connected to a memory comprised in the control unit 460, e.g. in the first controller 462*a*. The UI processor 468 may be configured to, for example, control the first power management entity 464*a*, the audio DSP 466 and data transfer to and from the control unit 460 via the first controller 462*a* and (further) processing of data in the first controller 462*a*. The UI processor may receive input or commands from a user interface of the chassis 100 connected thereto.

The second controller 462*b* is configured to be operational only in case external operating power is supplied from the external control device 480. The second power management entity 464*b* is configured to supply power via the wiring arrangement 150 on basis of the external operating power supplied from the external control device 480. The external control device 480 may control the USB hub 474, for connecting one of the connection ports 130, 130' connected to the control interface 140 via an USB bus. Consequently, data transfer to and from as well as the operation of an electronic device connectable thereto may be controlled by the external control device 480 via the second controller 462*b*.

The audio codec 472 may be configured to carry out digital-to-analog conversion of audio data received from the external control device 480 over a USB connection for provision to a speaker arrangement connectable to a connection port 130, 130'. The audio codec 472 may be, conversely, configured to carry out analog-to-digital conversion of audio data received e.g. from a microphone arrangement connectable to a connection port 130, 130'.

The functions of the exemplifying control unit 460 described hereinbefore serve merely as examples of the capabilities of the control unit 360. The control unit 360 may further comprise a number of further—physical or logical—processing and/or control units not described herein and/or the control unit 360 may omit one or more of the functions described in context of the exemplifying control unit 460. As non-limiting examples, the exemplifying control unit 460 may be modified by omitting the second controller 462*b* and/or replacing the audio DSP and the UI processor 470 to a single The chassis 100 may further comprise a user interface. The user interface may comprise one or more buttons or keys for controlling the operation of an accessory device attached to the chassis 100 and connected to the control interface 140 via a connection port of the one or more connection ports 130, 130'. As an example, the user interface may comprise an 'on/off' button or switch for setting the electrical functions of the chassis 100 on or off.

As a further example, the user interface may comprise buttons 'up' and 'down', and a 'select' button. As an example, the control unit 360 may be configured to cause increasing the volume of an audio signal played back via a speaker arrangement connected to the chassis 100 in response to push of the 'up' button and to cause decreasing the volume of an audio signal played back via the speaker arrangement in response to push of the 'down' button. As another example, the control unit 360 may be configured to cause increase in brightness of a lamp connected to the chassis 100 in response to push of the 'up' button and to cause decrease in brightness of the lamp in response to push of the 'down' button. As a further example, the control unit 360 may be configured to cause turning on a night vision device connected to the chassis 100 in response to push of the 'up' button and to cause turning off the night vision device in response to push of the 'down' button. The action associated with push of the 'up' or 'down' buttons may be selected or changed by pushing the 'select' button.

The operation or function of the buttons may be configurable during manufacture of the chassis 100, hence providing a predetermined set of button configurations for supporting the respective set of electronic accessory devices that may be attached to the chassis 100. Alternatively or additionally, the operation or function of the buttons may be configurable or re-configurable during maintenance of the chassis 100, thereby providing a possibility to (re-) configure the buttons to support additional electronic accessory devices and/or to change operation of function of the buttons for a given electronic accessory device.

The user interface may be provided in the body 110 of the chassis, e.g. near the rim on the outer surface of the body 110 in a position that is close to a temple of a user when the chassis 100 is worn by the user.

The chassis 100 is attachable to a protective structure having a shape suitable for protecting the head of a user from an external impact. The chassis 100 may be detachably attached to the protective structure, thereby enabling the user e.g. to remove a protective structure and to replace with another one having different characteristics. Consequently, the chassis 100 may be provided to a user as a kit of parts comprising the chassis 100 together with one or more protective structures, possibly with one of the protective structures preattached to the chassis 100 for immediate use as a helmet for providing desired primary extent of protection. Since, as described hereinbefore, the chassis 100 being a wearable component with the structure of its body 110 designed to provide impact protection, the wearable chassis 100 may be applied for head protection also without the protective structure attached thereto. Moreover, as also described hereinbefore, the chassis 100 further comprises one or more connection ports 130, 130' for connecting electronic devices to the chassis 100 and the wiring arrangement 150 for connecting the connection ports 130, 130' to the control interface 140 and possibly also the mounting arrangement for attaching one or more accessory devices to the chassis 100. Therefore, the wearable chassis 100 may also be used e.g. for the purpose of carrying and using electronic devices connected to the chassis 100 and possibly also for the purpose of carrying and using accessory devices mounted to the chassis 100, with or without the protective structure attached thereto. Consequently, the chassis 100 may be provided without any protective structures.

Alternatively, the chassis 100 may be attached to the protective structure as part of the manufacturing process of a helmet, thereby leaving the end-user without an option to remove and replace the protective with another one but still providing a benefit of streamlined manufacturing process that enables usage of the chassis 100 as a component of a number of different types of helmets.

The characteristics of the protective structure may be selected in view of the intended usage of a helmet constructed using the chassis 100 and the protective structure. As an example, the protective structure may comprise or be formed of a material that provides ballistic protection, thereby making a helmet comprising the chassis 100 and the protective structure suitable for military use also in combat conditions. Such protective structure may comprise a shell approximating the shape of the top and back of the head of a user. The material providing ballistic protection may comprise for example plastic composite, arranged in a layered structure for high ballistic protection. Examples of such plastics composites include aramid fiber reinforced laminates and ultra-highmolecular-weight polyethylene (UHMWPE) fiber reinforced laminates.

As another example, the protective structure may comprise or be formed of a material that does not provide ballistic protection but rather provides an impact protection, thereby making a helmet comprising the chassis 100 and the protective structure suitable for use in military training conditions or inside military vehicles in combat conditions, as well as suitable for various non-military purposes, e.g. by the police, by firefighters, by construction workers, by miners, etc. The intended usage typically sets requirements for the shape and materials used for the protective structure providing impact protection. However, in most of the applications the protective structure providing impact protection may comprise a shell approximating the shape of the head of a user, the shell being formed of a material providing sufficient impact protection—together with the chassis 100—in view of the intended usage of the helmet. Typically, a shell formed of injection moulded plastic, e.g. acrylonitrile butadiene styrene (ABS), of desired thickness provides sufficient impact protection.

The chassis 100 may be mechanically attachable to a protective structure. As an example, the protective structure may be attached to the outer surface of the body 110 of the chassis 100 by screws through openings arranged in the protective structure, thereby providing detachable attachment of the protective structure. Additionally the chassis 100 and the protective structure may comprise a further installation arrangement to facilitate easy and correct attachment therebetween. As an example, the protective structure may comprise one or more small ridges extending from the surface of the protective structure configured to be facing the outer surface of the chassis 100, and the outer surface of the body 110 of the chassis 100 may comprise one or more recesses for receiving the one more small ridges such that the chassis 100 is correctly positioned inside the protective structure when the one or more ridges in the protective structure are inserted to the one or more recesses in the body 110. The one or more recesses may be provided for example near the rim of the outer surface of the body 110, e.g. in the portion of the body 110 that is positioned above the forehead of a user the chassis 110 is worn by the user.

As a variation of such an installation arrangement, the one or more ridges may be provided in the body 110 of the chassis 100 while the one or more recesses are provided in the protective structure. As a further variation, the protective structure may be provided with one or more ridges or hooks extending from the protective structure near the rim thereof such that the chassis 100 is correctly positioned inside the protective structure when the one or more ridges in the protective structure extend over the rim of the outer surface of the body 110 and are brought in contact with the rim of the body 110.

The chassis 100 is preferably attachable to the protective structure such that the mounting arrangement or a portion thereof, e.g. one or more mounting rails, are left exposed to enable subsequent attachment of an accessory device. The chassis 100 is also preferably attachable to the protective structure such that the one or more of the one or more connection ports 130, 130' are left exposed to enable subsequent connection of an electronic device.

In particular, the chassis 100 may be provided with an inner part and outer part such that a portion of the protective structure is placed between the inner and outer parts of the chassis 100 when attached to the chassis 100. In other words, the inner and outer parts of the chassis 100 are arranged to surround a portion of the protective structure when attached to the chassis 100. Such an arrangement facilitates reliable and correct attachment of the protective structure to the chassis 100 while also enables leaving some parts of the chassis 100 outside the protective structure for easy and convenient access by the user.

Figure 5:
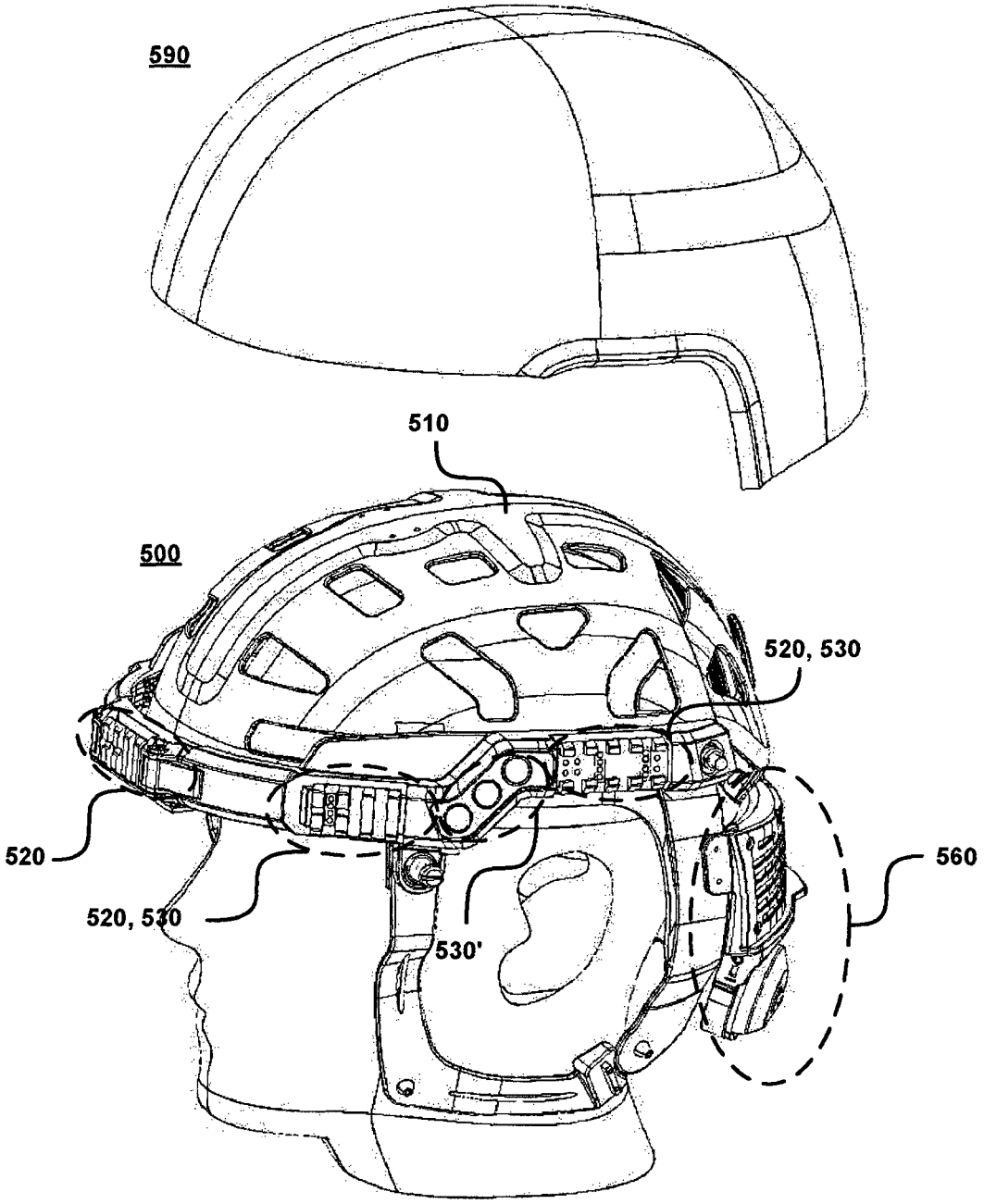
FIG. 5 schematically illustrates a chassis according to an embodiment of the invention and an example of a protective structure attachable to the chassis.

As an example in this regard, FIG. 5 schematically illustrates a chassis 500, serving as an example of the chassis 100 according to an embodiment. FIG. 5 further illustrates a protective structure 590 attachable to face the outer surface of the body of the chassis 500 to provide additional protection for the head of a user wearing the chassis 500. Similarly, FIG. 6 schematically illustrates a chassis 600 serving as another example of the chassis 100 according to an embodiment, FIG. 6 further illustrating a protective structure 690 attachable to face the outer surface of the body of the chassis 600 to provide additional protection for the head of a user wearing the chassis 600.

Figure 6:
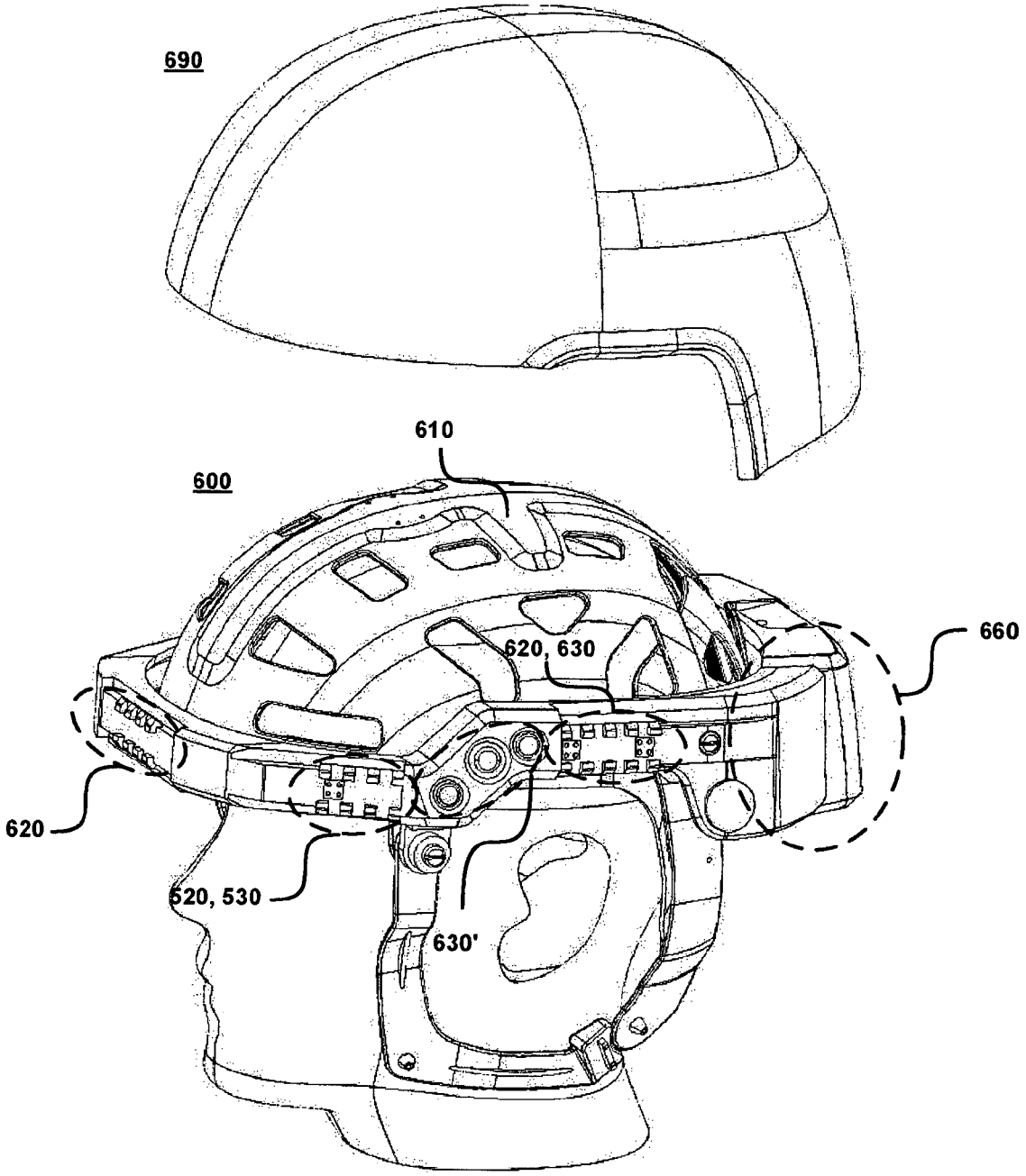
FIG. 6 schematically illustrates a chassis according to an embodiment of the invention and an example of a protective structure attachable to the chassis.

FIGS. 5 and 6 schematically illustrate some components of the chassis 500 and 600, respectively, while some of the components of the chassis 500 and 600 are not visible in the respective illustrations. In this regard, FIGS. 5 and 6 illustrate the bodies 510, 610 of the respective chassis 500, 600. FIGS. 5 and 6 further illustrate accessory rails (or mounting rails) 520, 620 arranged in the body 510, 610 of the respective chassis 500, 600 near the rim of the outer surface of the body 510, 610. The accessory rails 520, 620 serve as examples of the mounting arrangement (or mounting rails 120) provided in the chassis. FIGS. 5 and 6 further illustrate connection ports 530, 630 integrated to the respective accessory rails 520, 620, serving as examples of connection ports 130 provided in conjunction with the mounting rails 120. FIGS. 5 and 6 further illustrate connection ports 530', 630' provided separately from the respective accessory rails 520, 630, serving as examples of connection ports 130' provided separately from the mounting arrangement. FIGS. 5 and 6 further illustrate control units 560, 660 integrated to the respective chassis 500, 600, the control units 560, 660 arranged to control operation of one or more accessory/electronic devices connected to the respective chassis 500, 600 and serving as an example of the control unit 360.

As illustrated in FIGS. 5 and 6, a main difference between chassis 500 and 600 lies in the location of the control unit: while in the chassis 500 the control unit 560 in lower part of the back portion of the body 510, in the chassis 600 the control unit 660 is located in the middle/upper part of the back portion of the body 610. Another difference between the chassis 500 and 600 is the attachment between the protective structure and the chassis, described in more detail in the following.

Figure 7:
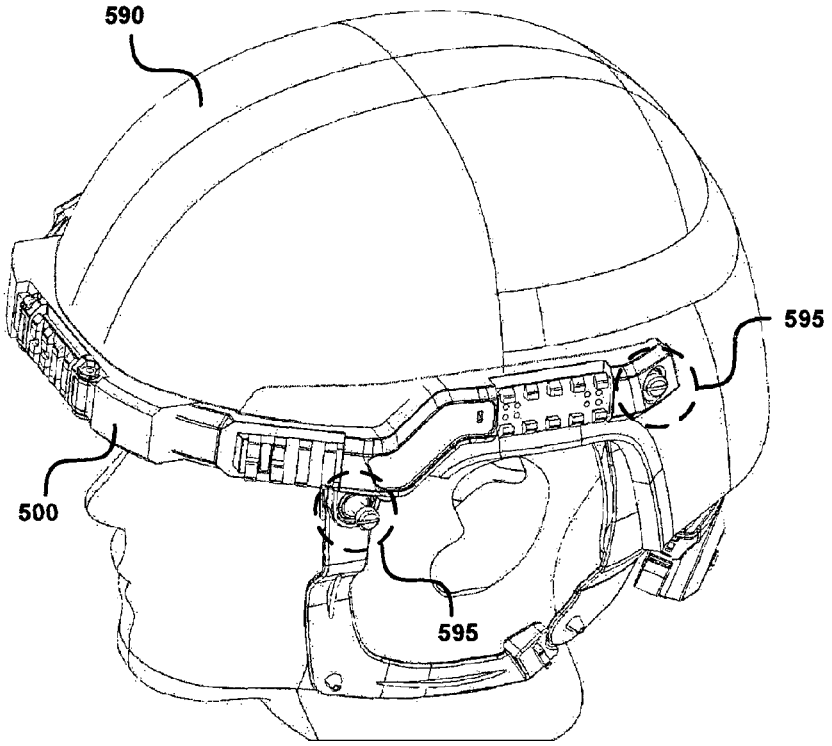
FIG. 7 schematically illustrates a protective structure attached to the chassis in accordance with an embodiment of the invention.

The attachment of the protective structure 590 to the chassis 500 is schematically illustrated in FIG. 7. The protective structure 590 covers the body 510 and the control unit 560 for additional protection from external impacts, while the accessory rails 520 and the connection ports 530, 530' are left exposed for easy access by the user. The portion of the chassis 500 comprising the body 510 and the control unit 560 may be considered as an inner part of the chassis 500, while the portion of the chassis 500 in which the accessory rails 520 and the connection ports 530, 530' are arranged may be considered as an outer part of the chassis 500.

As FIG. 7 shows, the protective structure 590 may be attachable to the chassis 500 such that a portion of the rim of the protective structure 590 is placed between the inner and outer portions of the chassis 500. In the example of FIG. 7 the outer portion of the chassis 500 is arranged to encircle a portion of the rim of the protective structure 590 (when attached to the chassis 500) covering approximately half of the circumference of the protective structure 590 in the front side, extending over the forehead of a user (when the user is wearing the chassis 500) approximately from one temple to another. In the example of FIG. 7 the protective structure 590 is removably attachable to the chassis 500 by screws 595 (only some of which may be visible in the illustration of FIG. 7).

Figure 8:
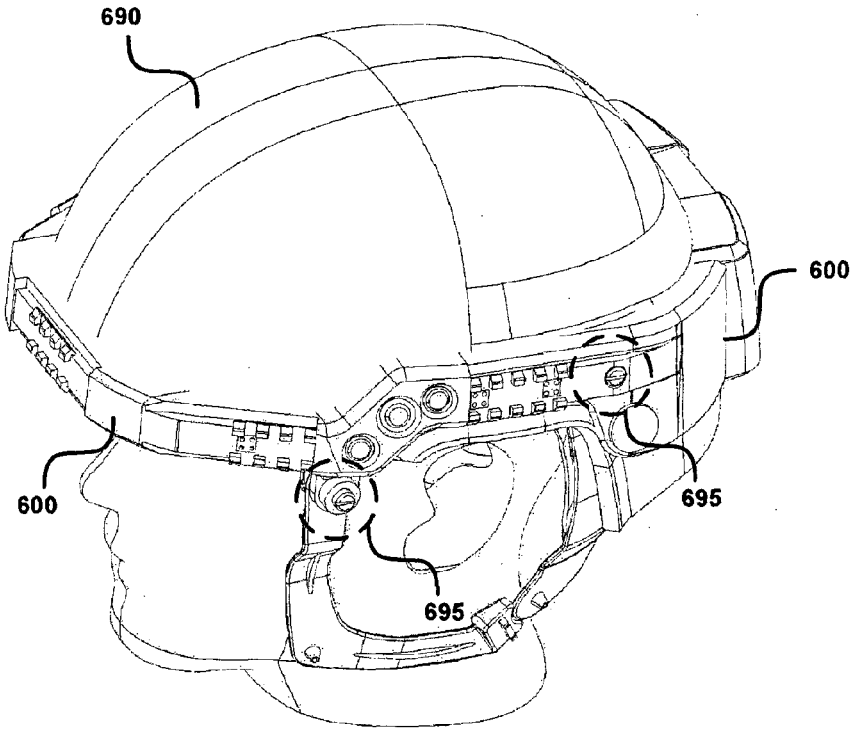
FIG. 8 schematically illustrates a protective structure attached to the chassis in accordance with an embodiment of the invention.

As another example, the attachment of the protective structure 690 to the chassis 600 is schematically illustrated in FIG. 8. The protective structure 690 covers the body 610 for additional protection from external impacts, while the accessory rails 620, the connection ports 630, 630' and the control unit 660 are left exposed for easy access by the user. The portion of the chassis 600 comprising the body 610 may hence be considered as an inner part of the chassis 600, while the portion of the chassis 600 in which the accessory rails 620, the connection ports 630, 630' and the control unit 660 are arranged may be considered as an outer part of the chassis 600.

As FIG. 8 shows, the protective structure 690 may be attachable to the chassis 600 such that a portion of the protective structure 690 is placed between the inner and outer portions of the chassis 600. In the example of FIG. 8 this portion of the protective structure 690 comprises a portion of the rim of the protective structure 690 (when attached to the chassis 600) covering approximately half of the circumference of the protective structure 690 in the front side (extending over the forehead of a user from a temple to another when the user is wearing the chassis 600) and at least part of the back portion of the protective structure 690. In particular, this portion of the protective structure 690 may comprise the portion of the outer part of the chassis 600 providing the control unit 660. In the example of FIG. 8 the protective structure 690 is removably attachable to the chassis 600 by screws 695 (only some of which may be visible in the illustration of FIG. 8).

The invention claimed is:

1. A helmet system comprising:

a protective structure having a shape protecting a head of a user from an external impact, which protective structure provides ballistic protection; and a wearable chassis attached inside said protective structure, wherein the chassis has a body having a shape suitable to be worn on a head of the user such that an inner side of the body is directly facing the head of the user, and the protective structure at least partially covers the body, the chassis comprising one or more connection ports for connecting an electronic device, the one or more connection ports located on the chassis, a control interface for connecting a control unit, a wiring arrangement for connecting the one or more connection ports to the control interface, and a mounting arrangement for attaching an accessory device to the chassis, the mounting arrangement located on the chassis, wherein the chassis further comprises an outer part exterior to the protective structure such that the body and the outer part are arranged to surround a portion of the protective structure, and wherein at least one of the connection ports and at least a portion of the mounting arrangement is provided in the outer part of the chassis.

2. The helmet system according to claim 1, wherein the mounting arrangement comprises one or more accessory rails for mounting an accessory device.

3. The helmet system according to claim 1, wherein the mounting arrangement is provided with one or more of said one or more connection ports for electrically connecting an accessory device attached thereto to the control interface.

4. The helmet system according to claim 1, wherein one or more of said one or more connection ports are configured for connecting a speaker arrangement.

5. The helmet system according to claim 1, wherein one or more of said one or more connection ports are configured for connecting a microphone arrangement.

6. The helmet system according to claim 1, wherein said wiring arrangement comprises a data bus connecting one or more of said one or more connection ports to the control interface.

7. The helmet system according to claim 1, wherein said wiring arrangement comprises a control bus connecting one or more of said one or more connection ports to the control interface.

8. The helmet system according to claim 1, further comprising the control unit coupled to the control interface, the control unit being configured to control an electronic device connectable to a connection port of the one or more connection ports.

9. The helmet system according to claim 8, wherein the control unit comprises a second control interface for connecting an external control device.

10. The helmet system according to claim 1, further comprising an arrangement for removably attaching the chassis inside the protective structure.

11. The helmet system according to claim 1, wherein, the body has a shape of an upper part of a human head, the body including a top portion and a back portion, a surface of the back portion designed to be facing the back of the head of the user with a shape of the back of the head of the user, and the protective structure at least partially covers the top portion and the back portion of the body.

12. The helmet system according to claim 1, wherein, the body has a shape of an upper part of a human head, the body including a top portion and a back portion, a surface of the back portion designed to be facing the back of the head of the user with a shape of the back of the head of the user, and the protective structure fully covers the top portion and the back portion of the body.

13. A helmet system comprising:

a protective structure having a shape protecting a head of a user from an external impact, which protective structure provides ballistic protection; and a wearable chassis attached inside said protective structure, wherein the chassis has a body having a shape suitable to be worn on a head of the user such that an inner side of the body is directly facing the head of the user, and the protective structure at least partially covers the body, the chassis comprising one or more connection ports for connecting an electronic device, the one or more connection ports located on the chassis, a control interface for connecting a control unit, a wiring arrangement for connecting the one or more connection ports to the control interface, and a mounting arrangement for attaching an accessory device to the chassis, the mounting arrangement located on the chassis, wherein, the body has a shape of an upper part of a human head, the body including a top portion and a back portion, a surface of the back portion designed to be facing the back of the head of the user with a shape of the back of the head of the user, and the protective structure at least partially covers the top portion and the back portion of the body, wherein the mounting arrangement comprises one or more accessory rails for mounting an accessory device, wherein the mounting arrangement is provided with one or more of said one or more connection ports for electrically connecting an accessory device attached thereto to the control interface.

14. The helmet system according to claim 13, wherein one or more of said one or more connection ports are configured for connecting a speaker arrangement or a microphone arrangement, wherein said wiring arrangement comprises a data bus connecting one or more of said one or more connection ports to the control interface coupled to a control unit, the control unit being configured to control an electronic device connectable to a connection port of the one or more connection ports, the control unit comprising a second control interface for connecting an external control device, and wherein said chassis is removably attached inside the protective structure.

15. The helmet system according to claim 13, wherein the control unit is located in a lower part of the back portion of the body, with the protective structure covering the control unit.

16. The helmet system according to claim 13, wherein the control unit is located in above a lower part of the back portion of the body, with the protective structure covering the control unit.

17. The helmet system according to claim 13, wherein the control unit is located in a lower part of the back portion of the body, with the protective structure covering the control unit while the accessory rails and the connection ports are not covered by the protective structure and are exposed for access by the user.

18. The helmet system according to claim 13, wherein the control unit is located in above a lower part of the back portion of the body, with the protective structure covering the control unit while the accessory rails and the connection ports are not covered by the protective structure and are exposed for access by the user.

* * * * *